US005445054A

United States Patent [19]

Pryor

[11] Patent Number: 5,445,054

[45] Date of Patent: Aug. 29, 1995

[54] SHEET CUTTING APPARATUS AND METHOD

[75] Inventor: James W. Pryor, Winston-Salem, N.C.

[73] Assignee: R. J. Reynolds Tobacco Company, Winston-Salem, N.C.

[21] Appl. No.: 125,054

[22] Filed: Sep. 21, 1993

[51] Int. Cl.[6] ..... B26D 1/147; B26D 1/20

[52] U.S. Cl. ..... 83/37; 83/43; 83/341; 83/349; 83/596; 83/46; 83/333

[58] Field of Search ..... 83/333, 349, 43, 46, 83/341, 591, 596, 37; 241/242, 243

[56] References Cited

U.S. PATENT DOCUMENTS

| | | | |
|---|---|---|---|
| 127,235 | 5/1872 | Heywood | 83/155 |
| 1,301,964 | 4/1919 | Overbury | 83/349 |
| 1,334,149 | 3/1920 | Frank | 83/43 |
| 1,666,204 | 4/1928 | Hrashberger | 83/333 |
| 1,874,902 | 8/1932 | Clyne | 83/43 |
| 2,315,028 | 3/1943 | Thomas | 241/243 |
| 2,335,515 | 11/1943 | Jehle | 83/43 |
| 2,993,400 | 7/1961 | Glenton et al. | 83/333 |
| 3,017,795 | 1/1962 | Joa | 83/129 |
| 3,119,312 | 1/1964 | Henc | 83/333 |
| 3,353,754 | 11/1967 | Heijnis et al. | 241/243 |
| 3,468,199 | 9/1969 | Hautau | 83/43 |
| 3,587,373 | 6/1971 | Astrand | 83/43 |
| 3,762,256 | 10/1973 | Frantz | 241/243 |
| 3,779,123 | 12/1973 | Chafee | 83/349 X |
| 4,308,776 | 1/1982 | Gillespie et al. | 83/344 |
| 4,422,358 | 12/1983 | Hull et al. | 83/356.3 |
| 5,146,820 | 9/1992 | Nemeth et al. | 83/37 |
| 5,297,746 | 3/1994 | McBride et al. | 241/242 |

FOREIGN PATENT DOCUMENTS 124255 7/1984 European Pat. Off. .

*Primary Examiner*—Kenneth E. Peterson

*Attorney, Agent, or Firm*—Grover M. Myers; George C. Myers, Jr.

[57] ABSTRACT

A sheet cutting apparatus and a method of cutting tobacco sheet into cut filler are disclosed. The apparatus comprises a fixed ledger blade and a rotatable cutter blade coacting with the ledger blade to simultaneously cut the tobacco sheet transversely and longitudinally into cut pieces useful as cut filler in a cigarette making process. The cut pieces may have a rectangular, zigzag or scalloped shape according to different embodiments of the invention.

25 Claims, 3 Drawing Sheets

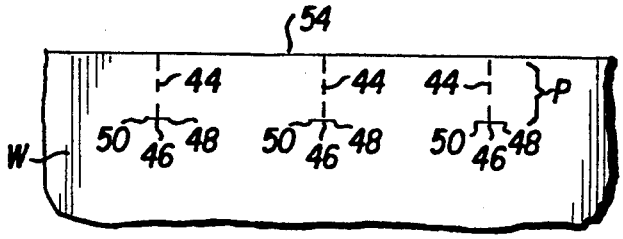
FIG. 4(a)
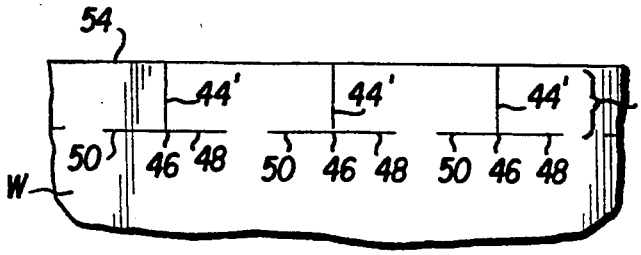
FIG. 4(b)
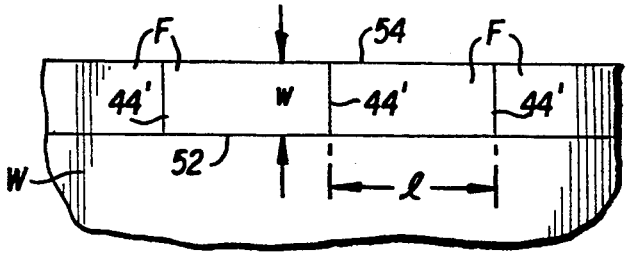
FIG. 4(c)
FIG. 7
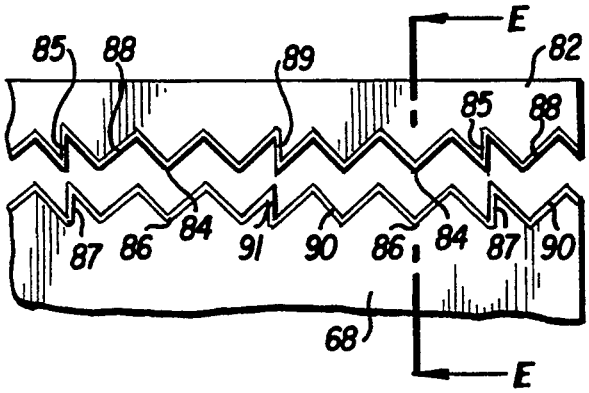
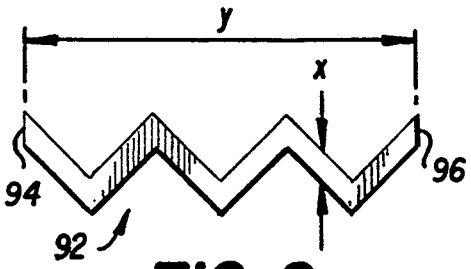
FIG. 8
FIG. 6
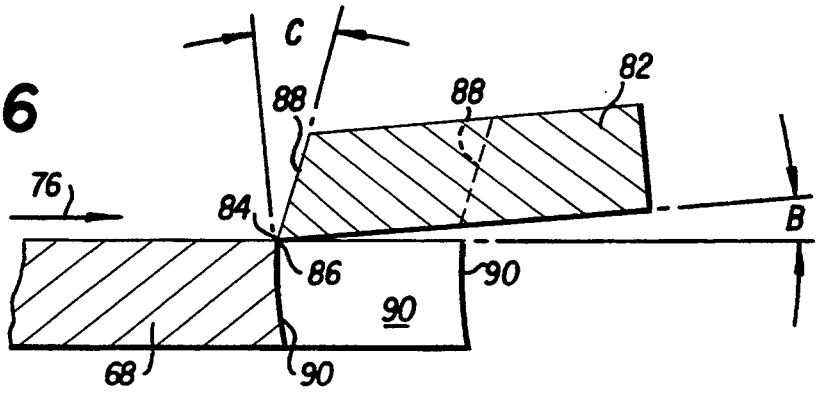

FIG. 5
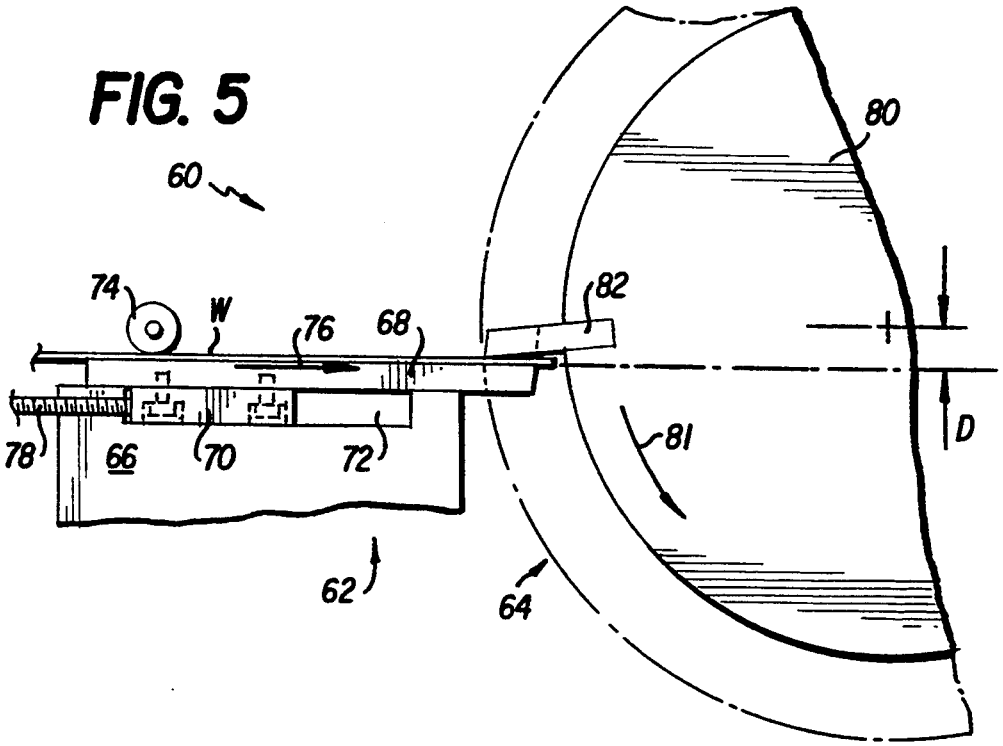
FIG. 9
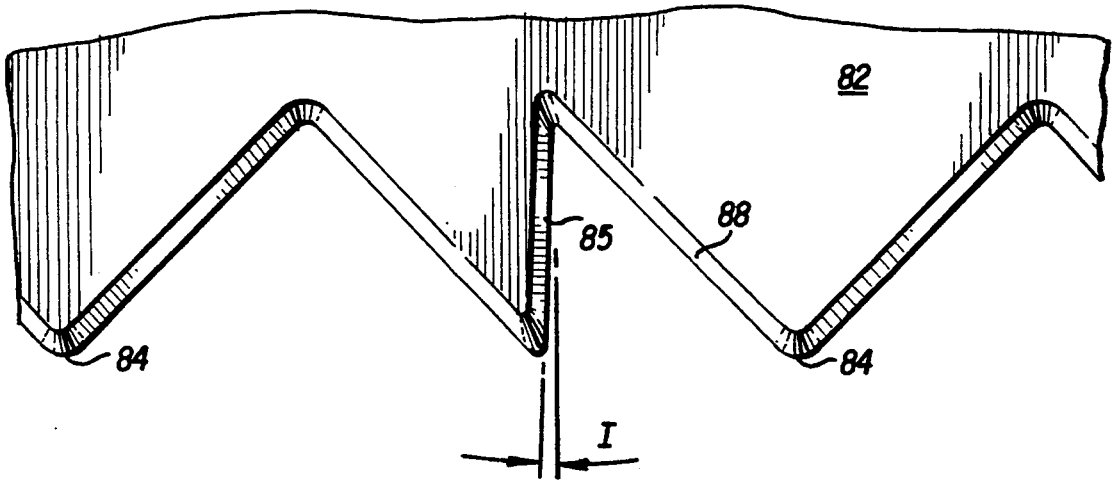
FIG. 10
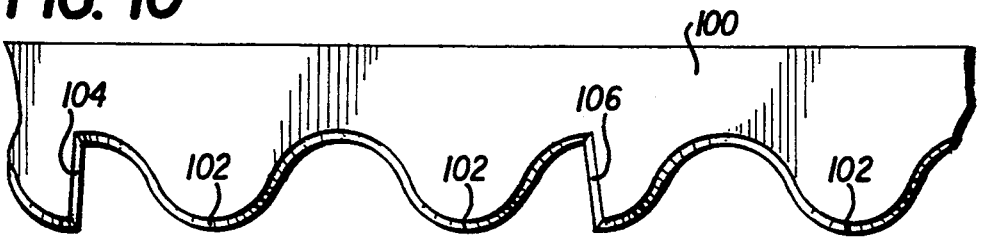
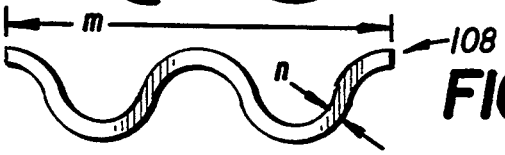
FIG. 11

SHEET CUTTING APPARATUS AND METHOD

FIELD OF THE INVENTION

The present invention relates to an apparatus for and a method of cutting a web of sheet material, such as reconstituted tobacco sheet, and more particularly to an apparatus for cutting a web of sheet material into a cut product having a desired length and width and a method of making cut filler from a sheet of reconstituted tobacco.

BACKGROUND OF THE INVENTION

In the cigarette making art, small particles of tobacco and tobacco fines resulting from the handling of tobacco leaf and the manufacture of cigarettes and other tobacco products are recycled into a web or sheet product known as reconstituted tobacco, for example, by conventional paper making processes. The webs or sheets are then cut into smaller pieces then shredded into strips useful as cut filler in the cigarette making process. Similarly, in other arts, such as plastic molding, a web of plastic sheet material may be cut into smaller pieces or chips for subsequent processing.

Typically, if the web to be cut into smaller pieces has a width greater than the desired dimensions of the final cut product, the web is slit longitudinally in the direction of travel of the web with one or more knives or cutters and is then cut transversely to the direction of travel. Alternatively, the web may be initially cut transversely across the web width to form elongated strips which are then cut into two or more strips of shorter lengths.

European Patent Publication No. 0124255 discloses one known apparatus and method of the former type for shredding a sheet material in which a longitudinally pre-slit web of reconstituted tobacco or blended leaf tobacco is fed off the end of a support table past a serrated ledger blade supported at the edge of the table. A complementary serrated blade fixed to a rotating cylinder strikes the projecting sheet portion extending past the ledger blade, penetrates the sheet and separates the projecting portion of the sheet by tearing. According to this cutter design, a clearance is maintained between the fixed ledger blade and the moving blade so that there is no interference between the blades. The absence of interference is said to be advantageous to solve the problems of blade wear, noise and blade adjustment owing to sagging of the rotating shaft of the cutter. Because the sheet material is longitudinally pre-slit, the transverse cutting or tearing of the projecting portion results in a cut product having a length equal to the spacing between the pre-slits and a width proportional to cutter speed and the feed rate of the sheet, i.e., equal to the distance the web of sheet material is advanced between successive cuts or tears by the moving blade or blades.

U.S. Pat. No. 2,335,515 to Jehle discloses a cutting method and apparatus with a fixed and a movable cutter which is used to cut a sheet of plastic material into small pieces or chips suitable for a plastic molding process. According to this patent, the movable cutter is made up of a plurality of toothed cutters arranged axially on a rotating shaft in two sets with the cutters of the first set alternating with the cutters of the second set and the teeth of the first set being circumferentially offset or staggered with the teeth of the second set. With this arrangement, rotation of the movable cutter and advancement of the sheet will cause one row of the first set of teeth to cut pieces from the sheet having a length equal to the transverse width of the teeth of the first set, then one row of the second set of teeth to cut pieces from the sheet having a length equal to the transverse width of the teeth of the second set, then the second row of the first set of teeth to cut pieces from the sheet and so on. Thus, each set of cutter teeth cuts alternate pieces from the sheet so that two rows of cutter teeth must cut the sheet to cut off pieces equal in length to one entire sheet width.

It would be desirable to provide a sheet cutting apparatus and method having a movable cutter blade that is capable of coacting with a fixed cutter blade to substantially simultaneously cut the entire width of a web of sheet material both longitudinally as well as transversely into cut pieces of desired dimensions so that pre-slitting of the sheet is unnecessary. It would also be desirable to provide a cutting apparatus having blades that are substantially self-sharpening and are characterized by substantially reduced blade wear.

SUMMARY THE INVENTION

The present invention is directed to a method of and an apparatus for cutting a web of sheet material into cut pieces having predetermined lengths and widths. According to the apparatus aspects of the invention, the sheet cutting apparatus comprises a fixed ledger blade mounted in a ledger block having a platen over which the web of sheet material is advanced by a feed roll. One or more movable cutter blades is fixed to a rotatable drum or shaft for coacting with the ledger blade to cut off a portion of the sheet projecting beyond the ledger blade in the direction of advancement of the sheet. Coaction between the cutter blade and the ledger blade substantially simultaneously cuts the projecting portion of the sheet transversely across the entire width of the sheet and longitudinally in one or more cuts in the direction of travel of the sheet.

In a first embodiment of the invention, the cut product is in the form of narrow, rectangular strips or pieces of sheet material. If the sheet material is a web of reconstituted tobacco, the strips or pieces may be used as cut filler along or in combination with cut filler made from tobacco leaf. In such case, the width of the cut filler strips may be about 1/32 inch and the length may range from about ½ inch to about 1 inch or more. The width of the cut strip is determined by the relationship between the rate of feed or advancement of the sheet, the rotational speed of the cutter drum or shaft and the number of cutter blades mounted to the rotatable drum or shaft.

The movable cutter blade is formed with a plurality of short, longitudinally-extending knife edges transversely spaced from one another a dimension or dimensions equal to the desired length or lengths of the cut pieces, e.g., ½ inch to 1 inch. Concave, generally cylindrically- or elliptically-shaped surfaces are formed between each knife edge so that the cutting face of the blade has an undulating or wave-like appearance. Each time the cutter blade or blades coact with the ledger blade a narrow strip is cut from the entire width of the web and that strip is substantially simultaneously cut by the knife edges into shorter lengths corresponding to the spacing between the knife edges.

The ledger blade is preferably made of a soft or mild steel and the cutter blade or blades is preferably made of a harder steel such as CPM 10 V. Because of the difference in hardness of the blades the ledger blade is a "sacrificial blade" and must be periodically adjusted by advancing the same toward the cutter blade so that the blades are essentially self-sharpening. It has been advantageously found with this arrangement that blade wear is relatively small, e.g., on the order of about 0.0001 inch per week, so that sharpness of the blades may be maintained by a relatively simple periodic adjustment of the ledger blade.

In a second embodiment of the invention, the ledger blade and the cutter blade or blades are provided with a complementary zigzag or sawtooth pattern or configuration. At spaced transverse intervals across the ledger and cutter blades, the sawtooth pattern is interrupted by complementary straight blade portions on the ledger and cutter blades extending at a slight angle to the longitudinal direction of feed of the web of sheet material. These blade portions coact with each other to cut the zigzag strip into lengths corresponding to the spacing between the complementary straight blade portions. This construction of the zigzag blades according to the invention is operative to cut a zigzag strip across the entire width of the web of sheet material and to simultaneously cut off the zigzag strip at spaced transverse intervals corresponding to the spacing between the straight blade portions. The ledger blade and cutting blades are made of the same materials as the corresponding blades of the first embodiment of the invention.

The straight blade portions are arranged at a slight angular inclination (about 1°) relative to the longitudinal movement of the web and to the axis of adjustment of the ledger blade. This slight angular offset from the adjustment axis is necessary to maintain the self-sharpening effect that would otherwise be absent if the straight blade portions of the ledger blade were adjustable parallel to the straight blade portions of the cutting blades. Each successive straight blade portion on the cutter blades is preferably arranged at an opposite angular inclination to the preceding straight blade portion so as to balance the transverse forces between the ledger blade and cutting blades when they coact with one another. If the angular inclination of all the straight blade portions were in the same direction, the transverse force between the blades would be substantial and could adversely affect the self-sharpening and cutting characteristics of the coacting blades.

According to a third embodiment of the invention, the ledger blade and the cutting blade or blades are provided with a complementary scalloped configuration similar to a sine wave pattern. Like the second embodiment of the invention, the scalloped pattern is interrupted at spaced transverse intervals by straight blade portions extending at a slight inclination to the direction of feed of the web or the adjustment direction of the ledger blade. These straight blade portions function in the same manner and are self-sharpening in the same way as the straight blade portions of the second embodiment.

Advantageously, the zigzag shape of the strips of the second embodiment and the scalloped shape of the strips of the third embodiment have an improved filling capacity when used as cut filler in a cigarette as compared with the narrow rectangular strips of the first embodiment. When used as cut filler, the zigzag and scalloped strips preferably have a width of about $\frac{1}{2}$ inch to 1/16 inch, a length of about $\frac{3}{4}$ inch to $1\frac{1}{2}$ inch and a peak-to-peak dimension of about 3/16 inch to $\frac{1}{4}$ inch.

According to the method aspects of the present invention, the cutting method comprises the step of rotating at least one cutting blade to coact with a stationary ledger blade to substantially simultaneously cut a web of sheet material both transversely and longitudinally into cut strips or pieces, especially to form cut filler from a sheet of reconstituted tobacco.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIGS. 4(*a*)–(*c*) are fragmentary top plan views of a web of sheet material showing the progression of the cuts made by the cutter blade of FIG. 3;

FIG. 5 is a fragmentary side elevation view of another embodiment of the cutting apparatus of the present invention;

FIG. 6 is an enlarged cross-sectional detail of the cutting apparatus of FIG. 5 showing the coaction of the cutting blades;

FIG. 7 is a fragmentary top plan view of the cutter blades of a second embodiment of the invention;

FIG. 8 is a top view of a cut zigzag strip or piece formed by the blades of the second embodiment of the invention;

FIG. 9 is an enlarged detail of the movable cutter blade shown in FIG. 7;

FIG. 10 is a fragmentary top plan view of a cutter blade of a third embodiment of the invention; and FIG. 11 is a top view of a cut scalloped strip formed by the blades of the third embodiment of the invention.

DETAILED DESCRIPTION OF THE INVENTION

Figure 1:
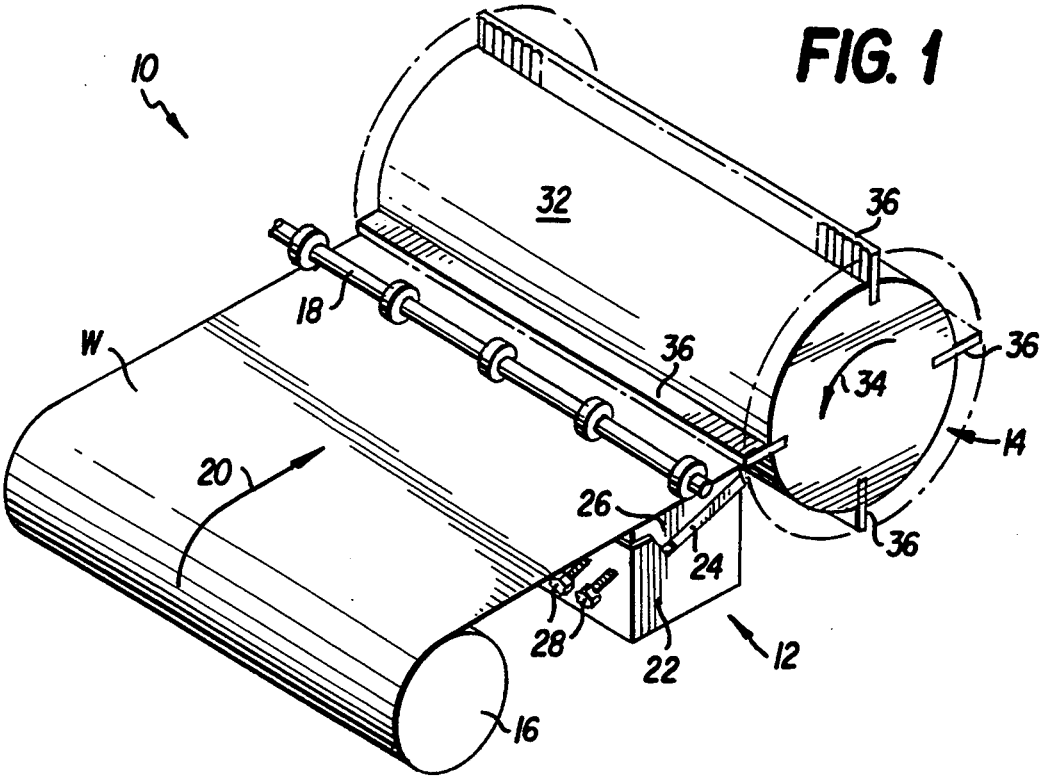
FIG. 1 is a perspective view of a first embodiment of the sheet cutting apparatus of the invention.

Referring now in detail to the drawings, there is illustrated in FIG. 1 a first embodiment of the sheet cutting apparatus of the invention which is designated generally by reference numeral 10. Only so much of the apparatus 10 is shown in FIG. 1 as is necessary for a complete understanding of the present invention, it being understood that other components of the apparatus, such as drive and control means for the rotatable elements and the like are necessary for operation of the apparatus.

Cutting apparatus 10 comprises a fixed cutter component 12 and a movable cutter component 14 for cutting a web W of sheet material, such as reconstituted tobacco sheet or the like, advanced from a roll 16 by a feed roller 18 in a longitudinal direction shown by arrow 20. Fixed cutter component 12 comprises a ledger block 22 on which a ledger blade 24 is mounted at an inclination in the range of about 15°–20° and rigidly clamped in place by a platen 26 fixed to the ledger block 22 by bolts (not shown) extending through openings (not shown) in the ledger blade. A plurality of ledger blade adjustment screws 28 are threadably mounted in the ledger block 22 for adjusting the ledger blade 24 in the direction shown by the arrow 30 in FIG. 2.

Movable cutter blade 14 comprises a drum 32 mounted for rotation on a shaft (not shown) for rotation in the counter-clockwise direction shown by the arrow 34. Rigidly mounted in slots the periphery of drum 32 are a plurality of cutter blades 36, four blades being shown in the FIG. 1 embodiment. While four blades 36 are shown, it will be understood that a greater or lesser number of cutter blades may be used. Typically, one to twenty-four blades are used. If the web W is reconstituted tobacco sheet, it typically would have a width of about two feet and the width of the fixed and movable cutter components 12, 14 would have a width at least the width of the web W.

Figure 2:
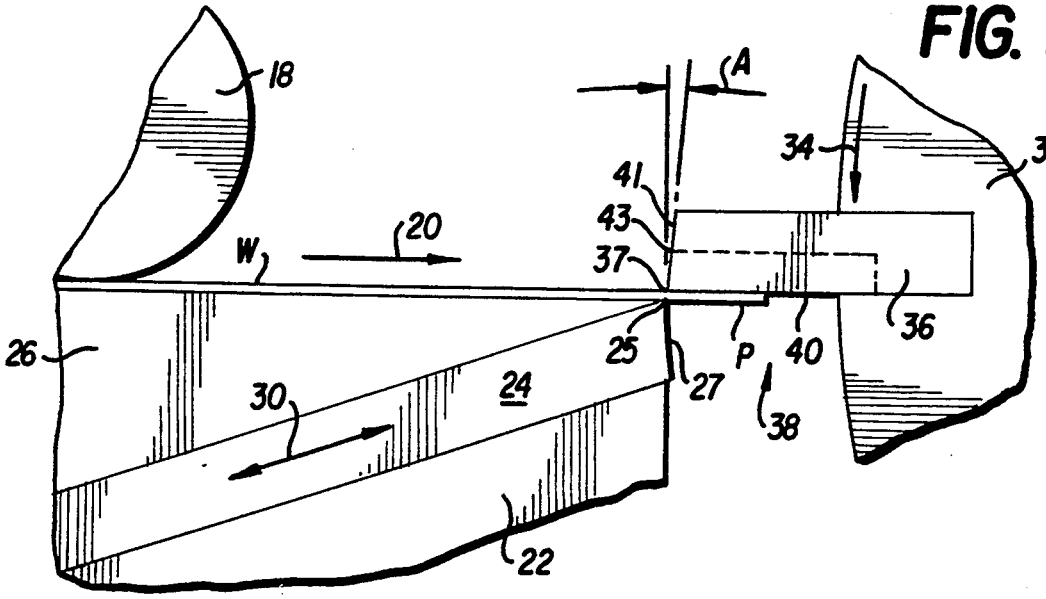
FIG. 2 is a fragmentary side elevation detail of the cutting apparatus of FIG. 1 showing the coaction of the cutting blades.
Figure 3:
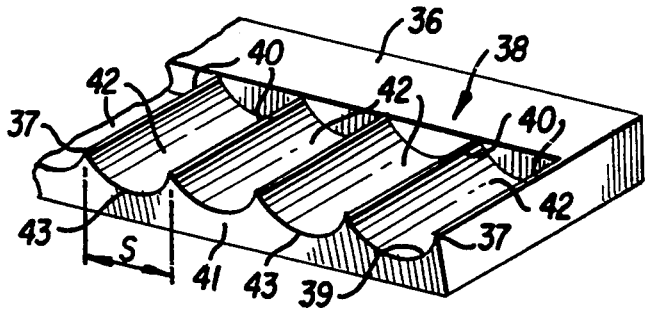
FIG. 3 is a fragmentary detail in perspective showing the cutting surfaces of the movable cutter blade of the cutting apparatus of the invention.

Now referring to FIGS. 2 and 3, the coaction of the ledger and cutter blades 24, 36 will be described. As the web W is advanced over platen 26 by feed roll 18 in the direction 20, a portion P of the web will be projected past the uppermost edge 25 of the ledger blade 24. Cutter blade 36 has a rake angle A which may be about 5°. The underside or cutting face 38 of cutter blade 36 is shown in FIG. 3 and is formed with a plurality of knife edges 40 extending in the direction of travel 20 of the web W, i.e., perpendicular to the rotational axis of the cutter drum 32. Between knife edges 40 cutter face 38 is provided with concave surfaces 42 which may have a generally circular, elliptical, or other curvilinear shape in cross-section. The cutter face 38 thus defines a wave-like or undulating edge 39 on the front face 41 of the cutter blade 36. The spacing S between the knife edges 40 defines the lengths of the pieces cut from the projecting portion P of the web W as explained hereinafter.

Referring again to FIG. 2, rotation of drum 32 in the counterclockwise direction 34 causes the knife edges 40 of cutter blade 36 to engage the top surface of the projecting portion P of the web. Continued rotation of the drum 32 causes each of the knife edges 40 to slit or cut through the projecting portion P in the longitudinal direction of feed of the web shown by arrow 20. When the outermost tips 37 of the knife edges 40 move past the uppermost edge 25 of ledger blade 24, the coaction between such edge 25 and the undulating edge 39 of the front face 41 of the cutter blade 36 gradually cuts slits in the web in each transverse direction from the knife edges 40 until the deepest points 43 (FIG. 3) of the concave surfaces 42 or undulating edge 39 move past the uppermost edge 25 of the ledger blade 24 at which time the slits join together to cut off projecting portion P from the web W.

The above-described cutting sequence is best illustrated with reference to FIGS. 4(*a*)-(*c*). Referring first to FIG. 4(*a*), the web W having front edge 54 is shown at the point in time when the knife edges 40 of the cutter blade 36 have slit or at least partially slit the projecting portion P of the web along lines 44 (shown partially cut by dashed lines) which are spaced apart a distance corresponding to spacing S in FIG. 3. The tips 37 of the knife edges 40 have penetrated the web at points 46 and have moved past the uppermost edge 25 of the ledger blade 24 to a point where the coaction between edges 39 and 25 have initiated transverse slits 48, 50 propagating in opposite directions from points 46. Continued counterclockwise rotation of the cutter blade 36 relative to the ledger blade 24 as shown in FIG. 4(*b*) causes the knife edges 40 to slit completely through the projecting portion P as shown by solid line slits 44' and further causes coaction between edges 25 and 39 to propagate the transverse slits 48, 50 toward one another from points 46. Finally, as shown in FIG. 4(*c*) the transverse slits 48, 50 join one another to cut off the projecting portion P from the web along continuous slit 52 when the points 43 on the undulating edge 39 pass or coact with edge 25 thereby cutting the projecting portion P into a plurality of individual cut pieces F defined by slits 52 and 44' and front edge 54 and having a width w corresponding to the width of projecting portion P and a length l corresponding to the spacing S (FIG. 3) between knife edges 40. It will be appreciated that the width w of the cut pieces F may be varied by changing the feed rate of the web, the rotational speed of the drum 32 or the number of blades 36 on the drum or a combination of any of those changes.

The cutter blade 36 is preferably made of a hard steel, such as CPM 10 V steel, and the ledger blade is made of a soft or mild steel. Because the cutter blade is made of a harder steel than the ledger blade, the ledger blade is a "sacrificial" blade that will be maintained sharp by periodic adjustment of the ledger blade toward the cutter blade in the direction of arrow 30 (FIG. 2). As shown in FIG. 2, the end face 27 of the ledger blade 24 has a large radius from top to bottom equal to the radius of the tips 37 of the cutter blade 36 from the rotational axis of drum 32. The rake angle A, which is preferably about 5°, prevents interference between the end face 41 of the cutter blade 36 and the end face 27 of the ledger blade 24 that might otherwise cause substantial blade wear. The thickness of the cutter blade 36 and ledger blade 24 is preferably in the range of about 1/16 inch to about $\frac{1}{8}$ inch but may be of greater or lesser thickness.

FIG. 5 illustrates another embodiment of a cutting apparatus 60 constructed according to the invention which comprises a fixed blade component 62 and a movable blade component 64. The fixed blade component 62 comprises a ledger block 66 having a ledger blade 68 mounted to the top surface thereof for slidable movement toward the movable blade component. Ledger blade 68 may be mounted for slidable movement in any suitable manner such as by a sliding block 70 bolted to the ledger blade 68 and keyed for sliding movement along a guideway 72 in the ledger block 66. Ledger blade 68 forms a platen over which a web W of sheet material, such as reconstituted tobacco sheet, is fed by means of a feed roll 74. The ledger blade 68 is adjustable in a horizontal plane toward the movable blade component 64 in the direction shown by arrow 76 by a plurality of adjustment screws 78 (only one shown). When the ledger blade 68 is properly adjusted, it may be bolted rigidly to the ledger block 66 by bolts (not shown).

The movable blade component 64 comprises a drum 80 rotatable in the direction of arrow 81 and having one or more cutter blades 82 rigidly affixed in slots in the periphery of drum 80. Cutter blades 82 preferably engage the ledger blade 68 at an angle. As shown in FIG. 5, this angular relationship may be accomplished by offsetting the rotational axis of the drum a distance D from the plane of the upper surface of the ledger blade 68. Alternatively, the upper surface of ledger blade 68 and the rotational axis of drum 80 may be in a common horizontal plane and the cutter blades 82 may be offset parallel to and clockwise from that plane, e.g., a distance D. In another possible arrangement, the cutter blades 82 may be affixed to the drum 80 at an angle to a radial line from the drum axis. The embodiment of the cutting apparatus 60 shown in FIG. 5 is especially useful for forming the zigzag or scalloped strips shown in FIGS. 8 and 11 as will be described hereinafter.

Referring now to FIGS. 6–8 which illustrate the zigzag pattern blades, and especially FIG. 6, the ledger blade 68 and cutter blade 82 are shown in enlarged detail in a cross-section taken along line E—E of FIG. 7. In FIG. 7 the blades 68, 82 have been spaced apart to show the entire blade surfaces, it being understood that in the position shown in FIG. 6 the blade 82 is in interengaging relationship with the blade 68. When the zigzag tips 84 of blade 82 engage the mating uppermost points 86 of the ledger blade 68, blade 82 is angularly offset at an angle B from the plane of the ledger blade 68. The zigzag face 88 of the cutter blade 82 is provided with a rake angle C greater than angle B to insure that there is no interference between zigzag face 88 and the zigzag face 90 of the ledger blade 68 as blade 82 rotates past blade 68. The straight complementary blade portions 85, 87 and 89, 91 are operative to cut longitudinal slits in the web which define the ends of each zigzag piece cut from the projecting portion of the web.

As in the first embodiment, the cutter blade 82 is made of a hard steel and the ledger blade 68 is a "sacrificial" blade made of a soft or mild steel. Thus, the lowermost zigzag edge of the cutter blade 82 cuts or shapes the zigzag face 90 of the ledger blade and maintains it in a sharpened condition. To accommodate the minimal wear between the blades, the ledger blade 68 is adjustable in the direction of arrow 76 by means of adjustment screws 78 (FIG. 5).

The blades 68, 82 shown in FIG. 7 when used in the apparatus 60 of FIG. 5 are operative to cut the zigzag strips 92 shown in FIG. 8 from the web W. The width X of the strips 92 as measured in the direction of web travel is, as in the first embodiment, a function of the feed rate of the web W and the rotational speed and number of cutter blades 82. The length y of the strips 92 is determined by the spacing between the complementary straight blade portions 85, 87 and 89, 91 (FIG. 7) which coact to cut longitudinal slits in the web W defining the ends 94, 96, respectively, of the strip 92.

The complementary straight blade portions 85, 87 and 89, 91 are preferably disposed at a slight angle of about 1° to the longitudinal direction of adjustment of the ledger blade 68 so that the straight blade portions are self-sharpening. It will be appreciated that if the straight blade portions are oriented parallel to the adjustment direction, the straight blade portions 85, 89 of the cutter blade 82 will not be operative to sharpen the straight blade portions 87, 91 of the sacrificial ledger blade 68. Preferably, the blade portions 85, 87 are arranged at a small angular inclination opposite to that of the straight blade portions 89, 91 so that the transverse force generated between the blade portions 85, 87 when those portions coact will be counterbalanced by the transverse force generated between the blade portions 89, 91 when those portions coact. It should be apparent that the number of coacting straight portions 85, 87 of the blades should be equal to the number of oppositely inclined coacting straight blade portions 89, 91 to exactly counterbalance the transverse forces between the blades 68, 82.

FIG. 9 illustrates in enlarged detail the small inclination angle I of straight blade portion 85 of cutter blade 82 which is necessary to sharpen the straight blade portion 87 of the ledger blade 68. Preferably, the angle I is about 1°.

FIG. 10 illustrates the cutter blade 100 of a third embodiment of the invention in which the blade pattern is scalloped or generally sinusoidal in shape. The blade 100 can be used in the apparatus 60 of FIG. 5 with a complementary shaped ledger blade (not shown). In cross-section taken longitudinally through one of the peaks 102 of the blade 100, the coacting cutter blade 100 and its ledger blade (not shown) will have essentially the same cross-sectional appearance as that shown in FIG. 6. Similarly, the straight blade portions 104, 106 have the same form, inclination and function as the straight blade portions 85, 89 respectively, of the blade 82 of the second embodiment. As also shown in FIG. 10, the straight blade portions 104, 106 are oppositely inclined to counter-balance the transverse forces caused by coaction of the complementary straight blade portions of the blade 100 and its ledger blade.

FIG. 11 shows one of the plurality of strips 108 that is cut from a projecting portion of the web W by a single cut by the cutter blade 100 in which the length m of the strip 108 is determined by the spacing between blade portions 104 and 106, and the width n is determined as in the second embodiment by the feed rate of the web W and the rotational speed and number of cutter blades. The third embodiment of the invention differs from the second embodiment only in the blade pattern and shape of the cut strip.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Apparatus for cutting a sheet material having a given width and an indeterminate length into cut pieces comprising:

means for feeding the sheet material in a longitudinal direction along its length;

a ledger blade having a width and adapted to be secured in a fixed position, said ledger blade comprising a straight cutting edge;

a rotatable cutter blade having a width and adapted to engage the ledger blade in a coacting relation to cut said sheet material, said cutter blade having an undulating cutting edge coacting with the straight cutting edge of the ledger blade and a plurality of knife edges intersecting said undulating cutting edge and extending in said longitudinal direction, said feeding means feeding the sheet material between said ledger blade and said cutter blade in said longitudinal direction along its length such that a projecting portion of said sheet material extends past said ledger blade; and said cutter blade and ledger blade including means for cutting off the projecting portion transversely across the entire given width of the sheet material and for substantially simultaneously cutting said projecting portion into a plurality of cut pieces.

2. Apparatus according to claim 1, wherein the coacting of said ledger and cutter blades cuts said projecting portion into a plurality of cut pieces by a plurality of cuts arranged substantially in said longitudinal direction.

3. Apparatus according to claim 2, including concave surfaces between said knife edges, said concave surfaces and said knife edges intersecting at a front face of said cutter blade to define said undulating cutting edge.

4. Apparatus according to claim 1, wherein said blades are made of steel material, the steel material of the cutter blade being harder than the steel material of the ledger blade.

5. Apparatus according to claim 4, wherein said cutter blade is made of CPM 10 V steel and said ledger blade is made of a soft or mild steel.

6. Apparatus according to claim 4, including means for adjusting said ledger blade in said longitudinal direction toward said cutter blade to accommodate wear between said blades and maintain the sharpness of said ledger blade.

7. Apparatus according to claim 1, wherein the cutter and ledger blades have complementary zigzag cutting portions including a plurality of complementary straight blade portions for cutting said projecting portion into said plurality of cut pieces.

8. Apparatus according to claim 7, wherein said complementary straight blade portions are arranged at an inclination of about 1° to said longitudinal direction.

9. Apparatus according to claim 7, wherein said straight blade portions are arranged in spaced relationship transversely across the width of the ledger blade and cutter blade, alternating ones of said complementary straight blade portions being inclined to said longitudinal direction in opposite directions.

10. Apparatus according to claim 1, wherein the coacting of said ledger and cutter blades cuts said projecting portion into a plurality of cut pieces by a plurality of cuts arranged at a slight inclination to said longitudinal direction.

11. Apparatus according to claim 10, wherein said inclination is about 1°.

12. Apparatus for cutting a sheet material having a given width and an indeterminate length into cut pieces comprising:

a ledger blade having a width and adapted to be secured in a fixed position;

a rotatable cutter blade having a width and adapted to engage the ledger blade in a coacting relation to cut said sheet material;

means for feeding the sheet material between said ledger blade and said cutter blade in a longitudinal direction along its length such that a projecting portion of said sheet material extends past said ledger blade; and said cutter blade and ledger blade including means for cutting off the projecting portion transversely across the entire given width of the sheet material and for substantially simultaneously cutting said projecting portion into a plurality of cut pieces, said cutter and ledger blades having complementary scalloped cutting portions including a plurality of complementary straight blade portions for cutting said projecting portion into said plurality of cut pieces.

13. Apparatus according to claim 12, wherein said complementary straight blade portions are arranged at an inclination of about 1° to said longitudinal direction.

14. Apparatus according to claim 12, wherein said straight blade portions are arranged in spaced relationship transversely across the width of the ledger blade and cutter blade, alternating ones of said complementary straight blade portions being inclined to said longitudinal direction in opposite directions.

15. Apparatus for cutting a sheet material having a given width and an indeterminate length into cut pieces comprising:

a ledger blade having a width and adapted to be secured in a fixed position;

a rotatable cutter blade having a width and adapted to engage the ledger blade in a coacting relation to cut said sheet material;

means for feeding the sheet material between said ledger blade and said cutter blade in a longitudinal direction along its length such that a projecting portion of said sheet material extends past said ledger blade; and the cutter and ledger blades having complementary scalloped cutting portions coacting to cut off the projecting portion transversely across the entire given width of the sheet material such that the cut off projecting portion has a substantially constant dimension in the longitudinal direction of feed of the sheet material across the entire given width of the sheet material, said blades including a plurality of complementary straight blade portions for substantially simultaneously cutting said projecting portion into a plurality of cut pieces.

16. Apparatus according to claim 15, wherein said straight blade portions are arranged in spaced relationship transversely across the width of the ledger blade and cutter blade, alternating ones of said complementary straight blade portions being inclined to said longitudinal direction in opposite directions.

17. Apparatus according to claim 15, wherein said complementary straight blade portions are arranged at an inclination of about 1° to said longitudinal direction.

18. A process for making cut filler from a sheet of reconstituted tobacco or leaf tobacco comprising the step of:

continuously feeding a sheet having a given width in a longitudinal direction over a fixed ledger blade with a scalloped cutting edge such that a portion of said sheet projects past the edge of said ledger blade;

rotating a cutter blade having a scalloped cutting edge complementary to the scalloped cutting edge of said ledger blade into engagement with the scalloped edge of said ledger blade;

coacting said blades to cut off the projecting portion of said sheet across the entire width of said sheet such that the cut off projecting portion has a substantially constant dimension in the longitudinal direction of feed of the sheet material across the entire given width of the sheet material, said blades further coacting to substantially simultaneously cut said projecting portion into a plurality of cut pieces having a scalloped shape and suitable for use as cut filler.

19. The process according to claim 18, wherein said blades are made of steel, the steel of said cutter blade being harder than the steel of the ledger blade and including the step of adjusting said ledger blade in said longitudinal direction toward said cutter blade to sharpen said ledger blade.

20. Apparatus for cutting a sheet material having a given width and an indeterminate length into cut pieces comprising:

means for feeding the sheet material in a longitudinal direction along its length;

a ledger blade comprising a straight cutting edge, said blade having a width and adapted to be secured in a fixed position;

a rotatable cutter blade having a width and adapted to engage the ledger blade in a coacting relation to cut said sheet material, said cutter blade having an undulating cutting edge and a plurality of knife edges intersecting said undulating cutting edges and extending in said longitudinal direction;

means for feeding the sheet material between said ledger blade and said cutter blade in said longitudinal direction such that a projecting portion of said sheet material extends past said ledger blade; and said cutter blade and ledger blade including means coacting the edges thereof to cut off the projecting portion transversely across the entire given width of the sheet material such that the cut off projecting portion has a substantially constant dimension in the longitudinal direction of feed of the sheet material across the entire given width of the sheet material, said blades further coacting with said plurality of knife edges to substantially simultaneously cut said projecting portion into a plurality of cut pieces.

21. Apparatus according to claim 20, wherein said coacting means of said ledger and cutter blades cuts said projecting portion into a plurality of cut pieces by a plurality of cuts arranged at a slight inclination to said longitudinal direction.

22. Apparatus according to claim 20, including concave surfaces between said knife edges, said concave surfaces and said knife edges intersecting at a front face of said cutter blade to define said undulating cutting edge.

23. Apparatus according to claim 20, wherein said coacting means of said ledger and cutter blades cuts said projecting portion into a plurality of cut pieces by a plurality of cuts arranged substantially in said longitudinal direction.

24. Apparatus for cutting a sheet material having a given width and an indeterminate length into cut pieces comprising:

a ledger blade having a width and adapted to be secured in a fixed position;

a rotatable cutter blade having a width and adapted to engage the ledger blade in a coacting relation to cut said sheet material;

means for feeding the sheet material between said ledger blade and said cutter blade in a longitudinal direction along its length such that a projecting portion of said sheet material extends past said ledger blade; and said cutter blade and ledger blade having complementary zigzag cutting portions and including means coacting to cut off the projecting portion transversely across the entire given width of the sheet material such that the cut off projecting portion has a substantially constant dimension in the longitudinal direction of feed of the sheet material across the entire given width of the sheet material, said blades including a plurality of complementary straight blade portions further coacting to substantially simultaneously cut said projecting portion into a plurality of cut pieces, said complementary straight blade portions being arranged at an inclination of about 1° to said longitudinal direction.

25. Apparatus according to claim 24, wherein said straight blade portions are arranged in spaced relationship transversely across the width of the ledger blade and cutter blade, alternating ones of said complementary straight blade portions being inclined to said longitudinal direction in opposite directions.

* * * * *